US009656926B1

(12) United States Patent
Thoma et al.

(10) Patent No.: US 9,656,926 B1
(45) Date of Patent: May 23, 2017

(54) SELF-CONSUMING MATERIALS

(71) Applicant: Sandia Corporation, Albuquerque, NM (US)

(72) Inventors: Steven G. Thoma, Albuquerque, NM (US); Mark C Grubelich, Albuquerque, NM (US); Mathias C. Celina, Albuquerque, NM (US); Mark R. Vaughn, Albuquerque, NM (US); Steven D. Knudsen, Stanley, NM (US)

(73) Assignee: Sandia Corporation, Albuquerque, NM (US)

( * ) Notice: Subject to any disclaimer, the term of this patent is extended or adjusted under 35 U.S.C. 154(b) by 679 days.

(21) Appl. No.: 13/943,959

(22) Filed: Jul. 17, 2013

Related U.S. Application Data

(60) Provisional application No. 61/673,616, filed on Jul. 19, 2012.

(51) Int. Cl.
*C06B 45/10* (2006.01)
*E21B 33/12* (2006.01)

(52) U.S. Cl.
CPC ..... *C06B 45/10* (2013.01); *E21B 33/12* (2013.01)

(58) Field of Classification Search
CPC ..... C08L 63/00
USPC ..... 523/400
See application file for complete search history.

(56) References Cited

U.S. PATENT DOCUMENTS 3,442,851 A * 5/1969 McManimie ..... C08F 20/12 524/492
3,898,111 A * 8/1975 Oberth ..... C06B 45/10 149/19.2
5,700,875 A * 12/1997 Zeng ..... A61K 6/0073 433/10
6,027,813 A * 2/2000 Deviny ..... C08F 4/52 428/422
6,652,608 B1 * 11/2003 Orr ..... C10L 1/023 44/314
7,504,443 B2 * 3/2009 Zeng ..... A61K 6/0023 433/228.1
7,572,303 B2 * 8/2009 Orr ..... C10L 1/023 44/320
8,132,987 B2 * 3/2012 Gerhard ..... B09C 1/06 405/128.85
2001/0001418 A1 * 5/2001 Wesson ..... E21B 37/08 166/297
2005/0044778 A1 * 3/2005 Orr ..... C10L 1/12 44/320
2005/0199323 A1 * 9/2005 Nielson ..... C06B 27/00 149/19.3
2007/0272112 A1 * 11/2007 Nielson ..... C06B 27/00 102/473
2009/0194744 A1 * 8/2009 Adebimpe ..... A01K 15/02 252/408.1
2009/0258966 A1 * 10/2009 Hirayama ..... A61K 6/0023 523/118
2013/0055918 A1 * 3/2013 Moser, Jr. ..... F02K 9/08 102/374

FOREIGN PATENT DOCUMENTS

WO WO 2007066125 A2 * 6/2007 ..... B09C 1/06

* cited by examiner

*Primary Examiner* — Megan McCulley
(74) *Attorney, Agent, or Firm* — Daniel J. Jenkins

(57) ABSTRACT

A self-consuming structure is disclosed that is formed from a self-consuming composition based on an epoxy or polyurethane having fuel and/or oxidizer molecularly dispersed and/or as particulates in the epoxy or polyurethane. The composition may be used to form self-consuming structural components.

26 Claims, No Drawings

SELF-CONSUMING MATERIALS

RELATED APPLICATIONS

This invention claims the benefit of U.S. Patent Application Nos. 61/673,616 filed on Jul. 19, 2012, entitled "SELF-CONSUMING MATERIALS", the contents of which are herein incorporated by reference in their entirety.

STATEMENT REGARDING FEDERALLY SPONSORED RESEARCH OR DEVELOPMENT

The United States Government has certain rights in this invention pursuant to Department of Energy Contract No. DE-AC04-94AL85000 with Sandia Corporation.

FIELD OF THE INVENTION

This invention relates generally to self-consuming materials, and more particularly to self-consuming compositions and structures formed from a rigid, thermosetting polymer, which includes an oxidizer and fuel cross-linked within the polymer or incorporated into the polymer matrix.

BACKGROUND OF THE INVENTION

Polymers and structures including polymers are often used for applications requiring that the material or structure be durable and long-lasting. However, some applications may require that the material or structure be removed at a future time. In such circumstances, these materials and structures may prove extremely difficult to remove.

Self-consuming polymer materials have been used as solid propellants. Composite propellants consist of a rubbery binder mixed with a solid oxidizer and homogenous or double base propellants consist of a mixture of nitrocellulose and nitroglycerin. Composite propellants lack sufficient mechanical properties to be used in structural applications and double base propellants suffer from a lack of high temperature stability and mechanical properties.

However, existing propellant materials use soft polymers that lack rigidity. Applications exist for the need of a rigid, self-consuming structure, which has not been met by current technology. The development of rigid self-consuming polymers enables applications that have not been previously realized by non-rigid self-consuming polymers, such as structures consisting entirely of structural support members and fiber reinforced composite engineered shapes within which further structural or insulating properties my be imparted by use of foam; all of which are comprised of the same basic self-consuming polymer, such that entire functional static or dynamic structures can be relieved of their structural value on demand.

There is a need for systems that must maintain their mechanical integrity and functionality, but can be destroyed when appropriate. Such systems require a polymeric material that is self-consuming and with sufficient mechanical properties as needed. Examples include items of limited life or importance that can be destroyed in place should the need arise. The material can be used for temporary plugs, seals or as a thermally activated safety device.

Thus, there is a need for a polymeric composition and structure that is rigid, offers suitable mechanical properties, and is self-consuming.

SUMMARY OF THE INVENTION

The present invention overcomes these difficulties encountered with prior art polymeric compositions. The present invention overcomes the limitations of the prior art by providing a polymeric composition that is rigid, has mechanical properties that offer structural support, both from a modulus and stress-strain behavior under load perspective (creep, maximum load and fracture behavior), and that is self-consuming. The polymeric material may be used to form rigid, self-consuming structures.

In an embodiment, a polymeric composition is disclosed that includes a rigid, cross-linked, thermosetting polymer (polymer), a fuel component and an oxidizer. In an embodiment, the fuel component and/or oxidizer are molecularly dispersed within the polymer. In an embodiment, the polymer having a fuel and an oxidizer molecularly dispersed has a Young's modulus (modulus) at room temperature (RT) greater than about 10 MPa with moduli achievable that are in the range required for structural materials concurrent with suitable mechanical properties under load bearing conditions. In another embodiment, the polymer having a fuel and an oxidizer molecularly dispersed has a modulus at RT greater than about 50 MPa with moduli achievable that are in the range required for structural materials concurrent with suitable mechanical properties under load bearing conditions. In another embodiment, the polymer may further include fuel and/or oxidizer particulates contained within the polymer matrix.

In this disclosure, the term "molecularly dispersed" means a material that is contained within another material primarily in a state such that it is associated primarily with the matrix material rather than aggregated with itself due to commonly known chemical and physical forces. The molecularly dispersed materials are homogeneously mixed at a molecular level as compared to heterogeneously mixed, i.e. powdered additives in a resin matrix. Molecular dispersion is achieved either via chemical adduct formation or the principles of dissolution, where the compounds of interest, either ionic salts or electrically neutral molecules, are dispersed and/or dissolved by chemical forces, for example electron pair donor acceptor interaction or similar processes that aid in adduct formation or dissolution of compounds, rather than physical forces. The term "molecularly dispersed" may also be referred to as molecularly dissolved or complexed.

In another component, a polymeric composition is disclosed that includes a polymer having fuel and/or oxidizer particulates or particles contained within the polymer matrix. In an embodiment, the polymer has a modulus at RT greater than about 10 MPa, with moduli achievable that are in the range required for structural materials concurrent with suitable mechanical properties under load bearing conditions. In another embodiment, the polymer having fuel and/or oxidizer molecularly dispersed has a Young's modulus (modulus) at room temperature (RT) greater than about 50 MPa, with moduli achievable that are in the range required for structural materials concurrent with suitable mechanical properties under load bearing conditions. In another embodiment, the polymer may further include fuel and/or oxidizer molecularly dispersed in the polymer matrix.

An object of the present invention is to provide rigid, self-consuming compositions and structures.

Another object of the present invention is to provide a rigid, self-consuming drilling packer or plug.

Another advantage of the present invention is provide a self-destruction capability to polymeric or composite based hardware.

Another advantage of the present invention is to provide a material system that enables fabrication of rigid, structural load-bearing members; fiber reinforced engineered shapes, structural foams, and adhesives from a self-consuming polymer system.

Other objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instruments and combinations particularly pointed out in the appended claims.

DETAILED DESCRIPTION

An embodiment of this invention provides for a self-consuming structure formed from a self-consuming composition based on a cross-linked, thermosetting polymer (polymer) having a Young's modulus (modulus) at room temperature (RT) greater than about 10 MPa with moduli achievable that are in the range required for structural materials concurrent with suitable mechanical properties under load bearing conditions. In another embodiment, the modulus may be between about 10 MPa and about 10 GPa. In another embodiment, the modulus may be between about 50 MPa and about 10 GPa. In another embodiment, the modulus may be between about 50 MPa and about 5 GPa. In another embodiment, the modulus may be greater than 100 MPa.

Self-Consuming Composition with Molecularly Dispersed Fuel/Oxidizer

In an embodiment, the self-consuming composition may include a polymer having a fuel and/or an oxidizer molecularly dispersed in the polymer. The polymer is a cross-linked, thermosetting epoxy or polyurethane material that includes molecules with reactive groups (i.e. epoxy or isocyanates) and their suitable curatives. The polymer is curable between a temperature of about ambient temperature and about 200° C. The polymer is present in the composition in an amount between about 10 weight percent (wt %) and about 90 wt %. In another embodiment, the polymer is between about 20 wt % and about 80 wt %. In another embodiment, the polymer is present in the composition in an amount between about 30 wt % and about 50 wt %.

The epoxy includes a resin and an activator or curative. The resin consists of monomers or short chain polymers with an epoxide group at either end. The curative consists of polyamine monomers. When these compounds are mixed, the amine groups react with the epoxide groups to form a covalent bond. Each hydrogen on an amino group represents an active site that can react with an epoxide group from distinct pre-polymer molecules, so that the resulting polymer is heavily crosslinked, and is thus rigid and strong.

The epoxy is selected with respect to reactivity, functionality and viscosity. In an embodiment, the epoxy may be a diglycidyl ether of bisphenol A (DGEBPA). In another embodiment, the epoxy may be a phenolic novolac material. The epoxy may be cured with various amines and by materials with aromatic or aliphatic acid anhydrides. Examples of epoxies that may be used are, but not limited to solid Epon™ 1001, Epon™ 1002, Epon™ 1004, Epon™ 1007, Epon™ 1009, Epon™ 1031 and Epon™ SU-8, a family of solid epoxies and Epon™ 160, Epon™ 161, Epon™ 154, Epon™ 826, Epon™ 828, Epon™ 830, Epon™ SU-2.5, Epon™ SU-3 a family of liquid epoxies manufactured by Momentive Specialty Chemicals, Inc. of Columbus, Ohio, and EN439, DER331 manufactured by Dow Chemical. Other exemplary epoxy materials may be the Epalloy® and Erisys® epoxies from the CVC Specialty Chemicals, Inc. resin company and the Araldite® resins like MY510, MY 720, MY 721 and similar compounds from Huntsman Corporation Advanced Materials. Also, the following epoxy resins may be used: the solid ERL-2002, 2003 and 3001 and the liquid ERL 2772, 2774 and 3794 manufactured by Bakelite Co. of the Union Carbide Plastics Division. Any epoxy resin that is comparable to the above listed epoxy resins may be used regardless of the manufacturer. Resins can be easily mixed to result in a suitable viscosity and reactivity range (epoxy equivalent reactivity by resin weight value). In an embodiment, the epoxy may be a triglycidyl reaction product of paraminophenol, such as MY510 or a tetraglycidyl reaction product of p-aminoaniline MY720/721 produced by Huntsman Advanced Materials, Salt Lake City, Utah. Any epoxy resins of similar nature with respect to viscosity, reactivity and functionality are of interest to this invention.

The curative may be a member of the broad families of aliphatic and aromatic amines or aromatic nitro-amino curatives. The aromatic nitro-amino curative may be a nitro-aniline, nitro-amino-aniline, or dinitro-anilines and their derivatives. Amines are organic compounds and functional groups that contain a basic nitrogen atom with a lone pair and reactive hydrogens. In an embodiment, the amine may be multifunctional i.e. containing two or more primary amines and two or more secondary amines per molecule. In an embodiment, the amine may be selected from the group including, but not limited to diethylenetriamine (DETA), triethylenetetramine (TETA), tetraethylenepentamine (TEPA), and pentaethylenehexamine (PEHA). Similarly, aromatic based amine curatives can be used, of which there are many types available, such as substituted anilines, dianilines, methylene-diphenylamine or similar compounds. Examples of aromatic based amine curative are phenylenediamines, alkyl-anilines or alkyl-amino-anilines or alkyl-amino-dianilines. An example of a commercial curative is HY5200 produced by the Shell Corporation, which is a substituted aniline derivative. Other suitable curatives with amine-hydrogen activity, particularly for high temperature materials, are found in the group of urea derivatives, cyanamide or dicyanamide based compounds.

Another group of curatives are found in the families of aliphatic and aromatic acid anhydride based curatives. Such curatives are used as alternatives to amine cured systems and offer different cure behavior with regard to cure speed, catalysis, mixing behavior and cure processing. Under normal considerations mixed amine and acid anhydride cured systems are rather unattractive due to chemical incompatibility issues, but in some cases they offer possibilities for fast chain extension or viscosity adjustments. On its own acid anhydride cured epoxies result in good rigid structural composite materials that are widely used in industry. Aromatic acid anhydride curing agents commonly used are tetrahydro phthalic anhydride (THPA), methyl-tetrahydro phthalic anhydride (MTHPA), hexahydro phthalic anhydride (HHPA), methyl-hexahydro phthalic anhydride (MHHPA), nadic methyl anhydride (NA), phthalic anhydride (PA) or its derivative like methylphthalic anhydride (MPA). Analogues and derivatives of these compounds are equally attractive curatives. Such compounds and combinations thereof are generally used as curatives in concentrations of less than 1:1 wt % with the epoxy resin. Similarly, higher melting point aromatic acid anhydrides like benzophenonetetracarboxylic dianhydride (BTDA), pyromellitic acid anhydride, or related compounds can be used as curatives with high temperature processing options. Low molecular weight aliphatic acid anhydrides are less commonly used but exist and have been used for epoxy cure. Such compounds are maleic anhydride, succinic anhydride, glutaric acid anhydride, adipic anhydride, as well as their analogues and derivatives, which have also been used as a partial cure additives or cure agents.

In an embodiment, catalytic curing agents may be used. Catalytic curing agents are those compounds that accelerate epoxy cure with curatives, promote epoxy-to-epoxy or epoxy-to-hydroxyl reactions and do not themselves serve as direct cross-linking agents. Tertiary amines, like substituted imidazoles, amine salts, boron trifluoride complexes, and amine borates are in this class. Examples of catalytic curing agents are benzyl dimethylamine (BDMA) or $BF_3$ by Air Products. In an embodiment, the catalytic curing agent may be a foaming and/or condensation/crosslinking catalyst, such as, but not limited to DABCO T-12, DABCO TMR, DABCO TMR-3, POLYCAT SA-102, DABCO T12, POLYCAT 26, DABCO MB20, POLYCAT 41, DABCO Crystalline, DABCO BL-17, DABCO BL-19, DABCO 33 LV, or CUREZOL 2E4MZ.

The catalytic curing agent may be used up to 1 wt % of the self-consuming composition. Most of these catalysts accelerate epoxy amine cure, particularly when slower reacting aromatic amines are employed. In an embodiment, the catalytic curing agent may be a sterically hindered, non-hydrogen-active imidazole derivatives, such as N-methylimidazole. Of importance in terms of catalysis is also to recognize that the oxidizers, fuel, reactive or modified curatives, and plasticizers of relevance to this invention may also possess catalytic tendencies, for example, based on ionic activity or free electron pairs.

The cross-linked, thermosetting polyurethane (PU) is a basic matrix material obtained from commonly used reactive isocyanates cured with commonly used polyols. As part of their curing reaction, the polyurethane may be foamed, partially foamed or not foamed. In an embodiment, the polyurethane may be a pMDI (polymeric methylene diisocyanate) and similar analogues, modified pMDI's such as pre-polymers, and aliphatic isocyanates cured with multifunctional polyols. In an embodiment, the polyurethane may be selected from the group including, but not limited to pMDI, IPDI (isophorone diisocyanate) cured with elastomer derived polyols, such as hydroxyl terminated polybutadiene (HTPB) and carboxy terminated polybutadiene (CTPB). In all cases, the resulting polyurethane networks are based on isocyanate-polyol cure chemistry and crosslinking commonly associated with polyurethane thermoset polymers. If PU materials, either in solid or foams shape are chosen, limits will exist with regard to the choice of other amine reactive constituents within the embodiments of this invention, since amines will be prohibitively fast reagents.

The polyurethane includes a resin and a curative that cross-link with one another to form a rigid, strong polymer. The resin is a bi- or higher functionality monomer containing two or more isocyanate functional groups (with formula —N═C═O). In an embodiment, the isocyanate may be pMDI or IPDI. The most commonly used diisocyanates include methylenebis(phenyl isocyanate) (MDI), toluene diisocyanate (TDI), and hexamethylene diisocyanate (HDI). Other common diisocyanates include naphthalene diisocyanate (NDI), methylene bis-cyclohexylisocyanate, (HMDI) (hydrogenated MDI), and isophorone diisocyanate (IPDI). Isocyanate resins are widely used polyurethane precursor resins and available in a large range from various manufacturers, i.e., Dow, Bayer, Huntsman and many others. Of particular interest are the polymeric MDI products that offer less vapor pressure than the traditional TDI based precursors. Examples of isocyanate resins are: Dow PAPI 20, 27, 580N, 901, 94, 2940, Isonate 143L, 181, the Bayer Mondur 445, 448, 489, 501, 541, 582, 841, 1437, 1453 and Bayer's various Desmodur isocyanates, the Huntsman Rubinate and Suprasec materials, i.e. Rubinate M, 44, 1680, 9225, 9433, 9447, 9009, 9490, 9495, 9520, 9040, 9272, 9511, 9234, 1245, 1820, 9016, 1670 and others, or Suprasec 5025, 9568, 9572, 9582, 9584, 9520, 9561. Any multi-functional reactive isocyanate resin that is comparable to the above listed materials can be used regardless of the manufacturer.

The curative is a monomer containing two or more hydroxyl groups (with formula —OH). In an embodiment, the curative is a multi-functional low viscosity polyol. In an embodiment, the polyol may be glycol or sucrose based OH terminated higher molecular weight reagents. Suitable polyols will act as cross-linkers in solid cured materials, or gelation agents during foam formation, if foamed carrier materials are desired. Polyols will quickly react with the isocyanate reagents in the resin mixture. Polyols are major industrial precursors and are available in many types as traditional aliphatic polyols, such as glycerol, butane diol, hexamethylene diol, various polyethers with different chain length, (both ethylene glycol and propylene glycol based) and polyester polyols, both aliphatic and aromatic derivatives, such as phthalic acid glycol esters. Such precursors are too numerous to list them all and examples are given as: The Jeffol Series from Huntsman, Jeffol PPG-1000, PPG2000, PPG2801, PPG3606, FX31-167, G30-240, G30-650, G31-28, G31-35, G31-43, R350X, R425X, R470X, A630, A800, AD310, AD500, S490, SA499, SD361, SD441, SD360, SG522. Similar product series are available from Bayer as Mutranol, Acclaim, Arcol, Hyperlite, Softcell and Ultracell polyethers, from Dow as Voranol, Voracor and Tone polyols, from Stepan company as Stepanpol materials (aromatic polyester polyols), i.e. Stepanpol PS4002, PS3152, PS2502, PS2402, PS 2352, PS1752 and others. Any polyol resin that is comparable to the above listed materials can be used regardless of the manufacturer.

The alcohol and the isocyanate groups combine to form a urethane linkage. The literature is well established to define the principles of PU manufacturing, cure initiation, and foamed PU processing. The reaction scheme is given by:

$$ROH+R'NCO \rightarrow ROC(O)N(H)R'$$ (R and R' are alkyl or aryl groups).

The PU polymerization reaction, as well as foaming if so desired, is catalyzed by tertiary amines, such as dimethylcyclohexylamine, and organometallic compounds, such as dibutyltin dilaurate or bismuth octanoate. Furthermore, catalysts can be chosen based on whether they favor the urethane (gel) reaction, such as 1,4-diazabicyclo[2.2.2]octane (also called DABCO or TEDA), or the urea (blow) reaction, such as bis-(2-dimethylaminoethyl)ether, or specifically drive the isocyanate trimerization reaction, such as potassium octoate. Suitable catalysts are from within the full range of commercial foaming and condensation/crosslinking catalysts, such as aliphatic amines, tertiary amines, imidazole derivatives, and Air Product's family of DABCO T-12, DABCO TMR, DABCO TMR-3, POLYCAT SA-102, DABCO T12, POLYCAT 26, DABCO MB20, POLYCAT 41, DABCO Crystalline, DABCO BL-17, DABCO BL-19, DABCO 33 LV, or CUREZOL 2E4MZ in commonly used quantities of between 0.05% and 1%.

In this embodiment, the self-consuming composition further includes a fuel and/or oxidizer molecularly dispersed in the cross-linked polymer. The fuel may be triethylborane (TEB), an organometallic compound such as triethyl aluminum (TEA), trimethyl beryllium (TMB), diethyl zinc DEZ, and/or compounds of similar nature, chemical reactivity and processability. In an embodiment, the fuel is triethylborane (TEB) suitably applied via stable amine-TEB adducts that results in molecularly dispersed fuel attached to aliphatic amines, with some amine functionalities retained for cure purposes. The fuel is then molecularly dispersed in the final polymer by premixing the particular fuel adduct in its bulk form in one of the bulk polymer precursor resin or other curative compounds.

The molecularly dispersed fuel is present in the self-consuming composition between about 0 wt. % and about 15 wt. %. In another embodiment, the fuel is present between about 5 wt. % and about 10 wt. %. In another embodiment, the fuel is present at about 10 wt. %.

Suitable fuel and combustion enhancing additives may be incorporated in a purely molecularly dispersed state, in combination of molecularly and heterogeneously dispersed state, or purely in a heterogeneously dispersed state.

The oxidizer may be an ammonium, alkali or alkaline earth metal salt of oxidizing nature based on derivatives of nitric, chloric and perchloric acid. Examples include, but are not limited metal nitrates, chlorates and perchlorates such as lithium nitrate, sodium perchlorate, ammonium perchlorate, and potassium chlorate. In an embodiment, the fuel may be sodium perchlorate, lithium chlorate or potassium perchlorate.

The oxidizer is molecularly dispersed in the polymer by premixing the oxidizer in its bulk form in one of the bulk polymer precursor liquids. Oxidizers may be incorporated in a purely molecularly dispersed state, in combination of molecularly and heterogeneously dispersed state, or purely in a heterogeneously dispersed state.

The molecularly dispersed oxidizer is present in the self-consuming composition between about 0 wt. % and about 15 wt. %. In another embodiment, the oxidizer is present between about 5 wt. % and about 10 wt. %. In another embodiment, the oxidizer is present at about 9 wt. %.

In this embodiment, the fuel and/or oxidizer are present in the self-consuming composition in an amount between about 0 wt. % and about 50 wt. %. In an embodiment, the fuel and oxidizer are 35 wt. % to about 45 wt. % of the composition. In another embodiment, the fuel and oxidizer are about 40 wt. % of the composition. In another embodiment, the fuel and oxidizer are present in the composition in an amount such that the oxygen from the oxidizer is in stoichiometric quantity to fully oxidize the fuel).

The self-consuming composition may include an energetic or high energy plasticizer. The plasticizer may be an azido or nitro compound. In an embodiment, the plasticizer may be 2,4-dinitrotoluene, glycidyl-azide, cyclopropylacetylene (ECP), trimethylolethane trinitrate or other azido or nitro compounds of processable viscosity, thermal stability and solubility properties.

The energetic plasticizer may be present in the self-consuming composition in an amount between about 0 wt. % and about 30 wt. %. In another embodiment, the energetic plasticizer may be present in an amount between about 20 wt. % and about 30 wt. %. In another embodiment, the energetic plasticizer may be present at about 25 wt. %.

The self-consuming composition may also include additional components, such as, but not limited to plasticizers, reinforcing fibers or particles, conductive particles or materials. In an embodiment, the composition may include woven or unwoven (chopped or not) fibers, veils, or mats, carbon fiber, glass fiber, and colloidal silica. In an embodiment, the composition may include any one or combination of carbon fibers, Kevlar™, e-glass/fiberglass, polyester fibers or other reinforcing components.

In another embodiment, the self-consuming composition may further include fuel and/or oxidizer particulates contained within the polymer matrix. This additional material, fuel and/or oxidizer particulates, are further described below.

Self-Consuming Composition with Particulate Fuel/Oxidizer

According to another embodiment of the invention, the self-consuming composition includes a polymer and fuel and/or oxidizer particulates contained within the polymer matrix. The polymer is a rigid, cross-linking epoxy or polyurethane as described above. However, in this embodiment, particulate fuel and/or oxidizer is dispersed in the polymer matrix. As in the prior embodiment, a catalyst may be used.

The fuel is a metal powder that provides additional energy in the combustion process, and can increase burn rate. The metal powder may be selected from the group including, but not limited to aluminum, iron, tantalum, titanium, boron, lithium, magnesium, tungsten, zinc, hafnium, uranium and zirconium. In an embodiment, the metal powder may be magnesium.

The fuel has a particle size of less than about 100 microns. In another embodiment, the fuel may have a particle size of less than about 50 microns. In another embodiment, the fuel has a particle size of less than about 2 microns. In another embodiment, the metal powder has particle size of less than about 1 micron.

The fuel is present in the self-consuming composition between about 0 wt. % and about 50 wt. %. In another embodiment, the fuel is present between about 10 wt. % and about 30 wt. %. In another embodiment, the fuel is present at about 25 wt. %.

The oxidizer is an ammonium, alkali or alkaline earth metal salt based on derivatives of nitric, chloric and perchloric acid or compounds of similar oxidizing nature, and/or iodine pentoxide. The alkali metal salt may be selected from the group including, but not limited to sodium/potassium chlorate, sodium/potassium perchlorate, and ammonium perchlorate. In an embodiment, the oxidizer is potassium perchlorate and/or iodine pentoxide.

The oxidizer is present in the self-consuming composition between about 0 wt. % and about wt. %. In another embodiment, the oxidizer is present between about 10 wt. % and about 50 wt. %. In another embodiment, the oxidizer is present at about 40 wt. %.

The fuel and oxidizer are present in the self-consuming composition in an amount between about 0 wt. % and about 50 wt. %. In an embodiment, the fuel and oxidizer are 35 wt. % to about 45 wt. % of the composition. In another embodiment, the fuel and oxidizer are about 40 wt. % of the composition. In another embodiment, the fuel and oxidizer are present in the composition in an amount such that the oxygen from the oxidizer is in stoichiometric quantity to fully oxidize the fuel).

As in the embodiment described above, an energetic plasticizer may be used.

As in the embodiment described above, additional components may be used.

In another embodiment, the self-consuming composition may further include fuel and/or oxidizer molecularly dispersed in the polymer. This additional material, molecularly dispersed fuel and/or oxidizer, is further described above.

Self-Consuming Composition with Molecularly Dispersed and/or Particulate Fuel/Oxidizer According to another embodiment of the invention, a rigid, self-consuming composition is disclosed that includes a polymer as described above. In this embodiment, the composition includes a fuel and/or oxidizer molecularly dispersed in the polymer and/or particulate fuel and or oxidizer dispersed within the polymer.

The total amount (molecularly dispersed and particulate) of fuel and/or oxidizer may be up to 70 wt % of the composition. In an embodiment, the fuel and oxidizer are 20 wt % to about 50 wt % of the composition. In another embodiment, the fuel and oxidizer are about 40 wt % of the composition. In another embodiment, the fuel and oxidizer are present in the composition in an amount such that the oxygen from the oxidizer is in stoichiometric quantity to fully oxidize the fuel.

Formation

The self-consuming composition is formed by mixing the epoxy components (resin and curative) or polyurethane components, adding the fuel and/or oxidizer, mixing to homogeneously disperse the fuel and/or oxidizer and to dissolve the fuel and/or oxidizer by the resin and curative, and applying and/or shaping the mixture to form a self-consuming structure. In another embodiment, the fuel/and or oxidizer may be added to the resin or polyurethane components prior to mixing.

Structure

A structure may be formed from and/or include the rigid, cross-linked composition. The structure is physically sound indefinitely unless the self-consuming trigger is initiated. The composition is water resistant and may be used in a wide range of environments. The composition may be formed into structures that will burn through sub-100 micron defined spaces, without requiring atmospheric oxygen for combustion.

The structure may be tailored to deliver a predetermined energy release by adjusting the amount of fuel and/or oxidizer in the composition. In such a manner, the structure may perform work on itself and/or its surroundings. For example, a structure may be formed from a composition having an energy release of greater than 30,000 J/g, which is equal or greater than the combustion of an equivalent amount of Mg or Al powder.

Structures formed from the disclosed composition are difficult to identify or detect as self-consuming. These structures are also difficult to reverse engineer, as some or all of the fuel and/or oxidizer is molecularly dispersed in the polymer. Such characteristics provide for enhanced security, and may provide asset protection, asset denial, and removal protection or commanded removal. For example, UAV and military components may include the self-consuming components to restrict access.

The structure may be molded, formed in-situ, foamed via standard plastic manufacturing techniques such as, but not limited to compression molding, casting, injection, molding rotational molding, and hand lay-up. For example, the composition may be formed into a well packer or bore seal or plug in situ. In another embodiment, the composition may be molded into a structural component such as, but not limited to a structural conduit, airframe, structural member, electronics component, electronics casing, and propellant. For example, the composition may be formed into an aircraft wing, fuselage or structural member such as a spar or beam, circuit board, electronic enclosure, computer case, and fasteners such as bolts, nuts, pins, or screws.

The structure may further include ignition, attachment, and other components. The additional components may be on the surface and/or embedded into the structure formed from the self-consuming composition. These components may include electronic and electro-mechanical systems In an embodiment, the composition may be used as an adhesive to bond items together that can be separated as needed, such as the removing the wing from a UAV fuselage or removing a plug from a well bore.

In an embodiment, the composition may be used as a foam. The foam may be used as an insulator (thermal or electrical), bonding material (adhesive) or space-filling structural material or potting material.

Ignition

The rigid, self-consuming composition is ignited by raising the composition to the self-ignition temperature. In an embodiment, the self-ignition temperature is between about 100° C. and 500° C. In another embodiment, the self-ignition temperature may be between 200 and 400° C. In another embodiment, the self-ignition temperature may be about 300° C.

The ignition components may be on the surface and/or embedded into the structure formed from the composition. Ignition may be initiated by any suitable heat source, such as, but not limited to spark, flame, chemical combustion, laser heating, hot wire, and friction.

Example

A rigid, self-consuming composition was formed using 330 parts by weight of a pre-mixture consisting of a multi-functional epoxy resin (i.e. Huntsman MY510) mixed with a soluble oxidizer (i.e. DNT, dinitrotoluene) in a ratio of 60 parts epoxy to 40 parts oxidizer. To this constituent 100 parts of a premixed curative was added consisting of 100 parts amine curative (i.e. DETA, diethylenetriamine) and 100 parts of a soluble oxidizer (sodium perchlorate). As a third constituent, 100 parts of an amine curative for example triethylenetetramine-triethylborane adduct is added. The resulting mixture then consists of approximately 37% epoxy resin, 25% DNT, 9.5% DETA, 9.5% sodium perchlorate and 19% TETA:TEB amine adduct. On a molecular reactivity basis such a mixture has an epoxy to amine equivalent weight ratio of approximately 1:2.38, and hence constitutes a significantly amine rich thermoset material.

According to another embodiment of the invention, a method of sealing a borehole is disclosed. In an embodiment, the method includes using the self-consuming material to form a drilling packer or plug between sections of pipe in a well bore. In another embodiment, the method includes using the self-consumable material to form a borehole plug to temporarily seal a the well bore.

Although the detailed description contains many specifics, these should not be construed as limiting the scope of the invention but merely as illustrating different examples and aspects of the invention. It should be appreciated that the scope of the invention includes other embodiments not discussed in detail above. Various other modifications, changes and variations which will be apparent to those skilled in the art may be made in the arrangement, operation and details of the method and apparatus of the present invention disclosed herein without departing from the spirit and scope of the invention as defined in the appended claims. Therefore, the scope of the invention should be determined by the appended claims and their legal equivalents.

What is claimed is:

1. A self-consuming composition, comprising:

a cross-linked, thermosetting polymer selected from the group consisting of an epoxy and a polyurethane;

a fuel; and an oxidizer;

wherein the fuel and/or oxidizer are molecularly dispersed in the cross-linked, thermosetting polymer; and wherein in the fuel is triethylborane.

2. The composition of claim 1, wherein the self-consuming composition has a Young's modulus greater than about 10 MPa.

3. The composition of claim 1, further comprising fuel and/or oxidizer particulates are contained in a matrix of the crosslinked, thermosetting epoxy or polyurethane.

4. The composition of claim 1, further comprising:

an energetic plasticizer.

5. The composition of claim 4, wherein the energetic plasticizer comprises dinitrotoluene.

6. The composition of claim 1, wherein the oxidizer is selected from a group consisting of an alkali metal salt and iodine pentoxide.

7. The composition of claim 6, wherein the alkali metal salt is selected from the group consisting of potassium chlorate, potassium perchlorate, and ammonium perchlorate.

8. A method of sealing a borehole, comprising:

casting in place or mechanically inserting a self-consuming structure selected from a group including a well bore packer, plug or seal into a well bore;

wherein the self-consuming structure is formed by the composition of claim 1.

9. The method of claim 8, further comprising:

igniting the self-consuming composition to substantially remove the structure from the borehole.

10. A self-consuming composition, comprising:

a cross-linked, thermosetting polymer selected from the group consisting of an epoxy and a polyurethane;

a fuel; and an oxidizer;

wherein the fuel and/or oxidizer are molecularly dispersed in the cross-linked, thermosetting polymer; and wherein the self-consuming composition has a Young's modulus greater than about 10 MPa; and wherein in the fuel is triethylborane incorporated via chemical adducts.

11. The composition of claim 10, further comprising another fuel and/or another oxidizer heterogeneously dispersed in the cross-linked, thermosetting polymer.

12. The composition of claim 10, further comprising:

an energetic plasticizer.

13. The composition of claim 12, wherein the energetic plasticizer comprises dinitrotoluene.

14. The composition of claim 10, wherein the oxidizer is selected from a group consisting of an alkali metal salt and iodine pentoxide.

15. The composition of claim 14, wherein the oxidizer is an alkali metal salt selected from the group consisting of potassium chlorate, potassium perchlorate, and ammonium perchlorate.

16. A structure, comprising:

a component formed from a self-consuming composition that comprises:

a cross-linked, thermosetting polymer selected from the group consisting of an epoxy and a polyurethane;

a fuel; and an oxidizer;

wherein the fuel and/or oxidizer are molecularly dispersed in the cross-linked, thermosetting polymer; and wherein in the fuel is triethylborane incorporated via chemical adducts.

17. The structure of claim 16, wherein the self-consuming composition has a Young's modulus greater than about 10 MPa.

18. The structure of claim 16, wherein the self-consuming composition further comprises fuel and/or oxidizer particulates contained in the crosslinked, thermosetting epoxy or polyurethane.

19. The structure of claim 16, wherein the self-consuming composition further comprising:

an energetic plasticizer.

20. The structure of claim 19, wherein the energetic plasticizer comprises dinitrotoluene.

21. The structure of claim 16, wherein the oxidizer is selected from a group consisting of an alkali metal salt and iodine pentoxide.

22. The structure of claim 21, wherein the alkali metal salt is selected from the group consisting of potassium chlorate, potassium perchlorate, and ammonium perchlorate.

23. The structure of claim 16, wherein the self-consuming structure is a drilling packer or plug.

24. The structure of claim 16, wherein the self-consuming structure is a component selected from the group consisting of a UAV structure, an electronic component, a release mechanism, an enclosure, a temporary composite structures, and a potting compound.

25. A method of sealing a borehole, comprising:

casting in place or mechanically inserting a self-consuming structure selected from a group including a well bore packer, plug or seal into a well bore;

wherein the self-consuming structure is formed by the composition of claim 16.

26. The method of claim 25, further comprising:

igniting the self-consuming composition to substantially remove the structure from the borehole.

* * * * *